United States Patent [19]

Mashimo

[11] 3,976,913

[45] Aug. 24, 1976

[54] AUTOMATIC FLASH DEVICE

[75] Inventor: Yukio Mashimo, Tokyo, Japan

[73] Assignee: Canon Kabushiki Kaisha, Tokyo, Japan

[22] Filed: Mar. 11, 1974

[21] Appl. No.: 450,213

Related U.S. Application Data

[63] Continuation of Ser. No. 271,516, July 13, 1972, abandoned.

[30] Foreign Application Priority Data

July 15, 1971 Japan ..... 46-52540

[52] U.S. Cl. ..... 315/241 P; 315/151; 315/159

[51] Int. Cl.[2] ..... H05B 37/00

[58] Field of Search..... 315/149, 151, 159, 241 R, 315/241 P

[56] References Cited

UNITED STATES PATENTS

| | | | |
|---|---|---|---|
| 3,591,829 | 7/1971 | Murata et al. | 315/151 |
| 3,650,189 | 3/1972 | Biber | 315/241 P |
| 3,681,649 | 8/1972 | Uno et al. | 315/241 P |
| 3,682,056 | 8/1972 | Kaisha | 315/241 P |
| 3,710,701 | 1/1973 | Takishima et al. | 315/227 X |

*Primary Examiner*—R. V. Rolinec
*Assistant Examiner*—Lawrence J. Dahl
*Attorney, Agent, or Firm*—Toren, McGeady and Stanger

[57] ABSTRACT

An automatic flash device comprising:

- a power source,
- a main capacitor to be charged to a certain level by said power source,
- a discharge circuit being connected to said main capacitor,
- a control circuit to make the amount of electricity discharged by said discharge circuit correspond to flash photographing information,
- a means to start discharging, which is actuated after a shutter release means of a camera is actuated to start the discharging of said main capacitor, and
- a means to cause a flash tube to emit light when the amount of electricity charged at the main capacitor reaches such a value as corresponds to flash photographing information.

24 Claims, 5 Drawing Figures

AUTOMATIC FLASH DEVICE

This is a continuation of application Ser. No. 271,516 filed July 13, 1972, now abandoned. The present invention relates to an automatic flash device, and particularly to such an automatic flash device in which the electric charge across a main capacitor of the flash device which has been charged beforehand is associated with the shutter release actions of a camera, such as pressing down of a shutter release or closing of a synchronizing contact, etc. The capacitor is discharged in correspondence to the distance from the subject to the camera, thus obtaining proper illumination or amount of emitting light as corresponding to the distance.

Heretofore, there has been such an automatic flash device that the amount of electricity charged across a main capacitor varies depending on the flash photographing informations for obtaining such an amount of emitting light as corresponding to the flash photographic information such as the distance to an object, the film sensitivity, etc. However, in this conventional type of an automatic flash device, the amount of electricity charged across the main capacitor is controlled before a shutter release action. That is, since an ordinary photographer sets the flash photographic information after the charging of the main capacitor of a flash device is completed, it is necessary to discharge the electric charge which has been so accumulated as corresponding to the value of the set photographic information, or to additionally charge the capacitor during the setting process. Particularly, there is a difficulty in setting the photographing distance in such a case. That is, ordinary focusing cannot be completed by one handling, instead focusing can be done after moving the lens to and fro. Therefore, the charging or discharging of the main capacitor must be done during the focusing process.

However, the present inventors have found that this problem can be eliminated if the amount of electricity charged across a main capacitor is controlled during the shutter releasing action. That is the shutter releasing action is done after all flash photographic information is set and it is impossible to change the same after the shutter release.

An object of the present invention is to provide an automatic flash device in which such an amount of emitting light as corresponding to flash photographic information can be obtained.

Another object of the present invention is to provide an automatic flash device in which the electric charge across a main capacitor is discharged in association with the shutter release operation until such an amount of emitting light as corresponding to the flash photographic information can be obtained.

Further another object of the present invention is to provide an automatic flash device having an indication device to indicate that the electric charge across a main capacitor has been discharged to such an extent that an amount of emitting light as corresponding to the flash photographic information has been obtained.

Still another object of the present invention is to provide an automatic flash device which automatically emits light when the electric charge across a main capacitor is discharged to such an extent that an amount of emitting light as corresponding to the flash photographic information has been obtained.

Further object of the present invention is to provide an automatic flash device having a means to impress voltage onto a flash discharge tube when the charged voltage at a main capacitor is too low.

The present invention will be explained in more detail referring to the attached drawings.

Figure 1:
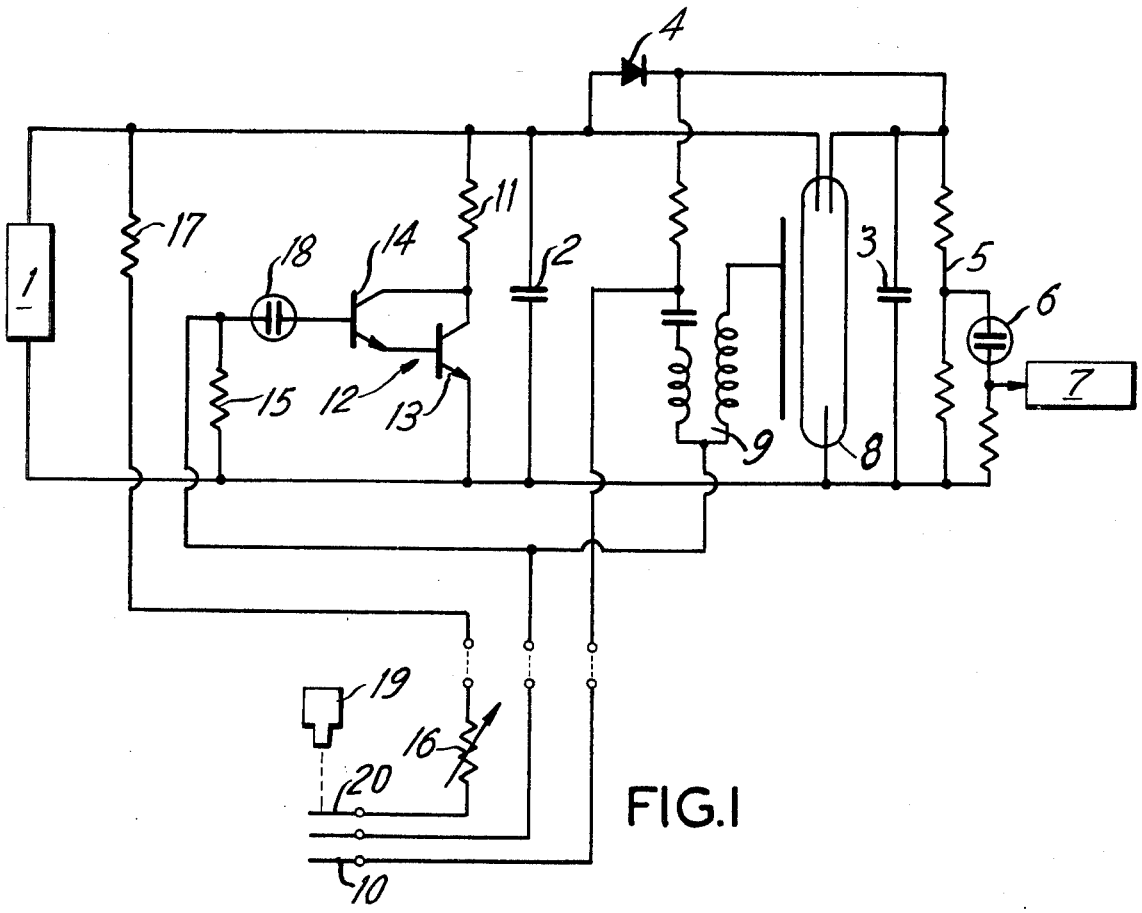
FIG. 1 is a circuit diagram showing a first example of the present invention.

Now, the first example shall be explained referring to FIG. 1. What is shown as 1 is a high voltage power source device. Numeral 2 is a main capacitor which is charged by the power source device. Numeral 3 is an auxiliary capacitor which is charged by the power source device 1. Numeral 4 is a diode provided on the auxiliary capacitor charging path between the main capacitor and the auxiliary capacitor. Numeral 5 is a detection circuit to detect the amount of electricity charged at the auxiliary capacitor. Numeral 6 is a neon light tube which emits light by the output of the detection circuit 5. Numeral 7 is a circuit to stop the charging of the main capacitor 2 and the auxiliary capacitor when the neon light tube 6 emits light. Numeral 8 is a triode flash discharge tube. Numeral 9 is a trigger circuit containing a synchronizing contact 10. Numeral 11 is a discharging circuit of the main capacitor 2. Numeral 12 is a switching circuit, being connected to the discharging circuit 11, and being composed of the transistors 13 and 14. 15, 16 and 17 are resistors composing a discharge control circuit. The resistor 16 is a variable resistor to vary the resistance value in association with a member to set such flash photographing informations as distance, film sensitivity, diaphragm, etc. Numeral 18 is a neon light tube which stops to be lighted when the amount of electricity charged at the main capacitor 2 becomes lower than such value as determined by the resistor 16, and which is provided between the output part of the discharge control circuit and the base of the transistor 14. This neon light tube should better be placed within a finder of a camera or within the field of vision of a finder. Numeral 19 is a shutter button and is to activate shutter release. Numeral 20 is a switch which is closed by a first step pressing down of the shutter release button, and is provided within the discharge control circuit or within the discharge circuit 11. The synchronizing contact 10 may be so made as being closed by the third step pressing down of the shutter button.

Next, an explanation shall be made on the function in the Example 1.

A power source switch (not shown in the drawing) is placed in "on" state and the main capacitor 2 and the auxiliary capacitor 3 are charged. When the amount of electricity charged at the main capacitor and the auxiliary capacitor reaches a certain value, the neon lamp 6 is lighted and the charging is stopped by the charging stop circuit 7. The value of the resistor 16 is determined by a flash photographic information setting member (not shown in the drawing). Now, when the shutter release member 19 is pressed down for a first step the switch 20 is closed. By said closing of the switch 20, the output of the discharge control circuit is generated.

The neon light lamp 18 is lighted by said output, and voltage is impressed on the base of the transistor 14. The switching circuit performs on action by said impressing. And the charge of the main capacitor 2 is rapidly discharged by the discharge circuit 11. At this time, the diode 4 which prevents reverse current is provided between the main capacitor 2 and the auxiliary capacitor 3, therefore the auxiliary capacitor 3 will not be discharged. By rapid discharge of the main capacitor 2, the output of the discharge control circuit varies rapidly, and the lighting of the neon light lamp 18 is stopped. The amount of electricity charged across the main capacitor 2 at this time is determined by the resistor 16. The switching circuit 12 becomes "off" by putting out of the neon light lamp 18 and the discharge of the capacitor 2 is stopped. The amount of electricity charged at the main capacitor 2 at this time corresponds to the flash photographic information which has been set before. Next, a shutter mechanism (not shown in the drawing) is activated by the second step pressing down of the shutter release member 19, and the shutter is opened. And at a certain point of shutter opening time, the synchronizing contact 10 is closed by a conventionally known method, then the trigger circuit 9 is activated to have the flash tube 8 emit light. The auxiliary capacitor 3 is to impress a high voltage at an early stage of illumination so that the flash discharge tube 8 emits light when the charged voltage of the main capacitor is low. Also the synchronizing contact 10 may be closed by the third step pressing down of the shutter release member 19. If the neon light lamp 18 is positioned within the finder or within the field of vision of the finder, the time of the second stage pressing down of the shutter release member 19 can be detected and thus it will be very convenient.

Figure 2:
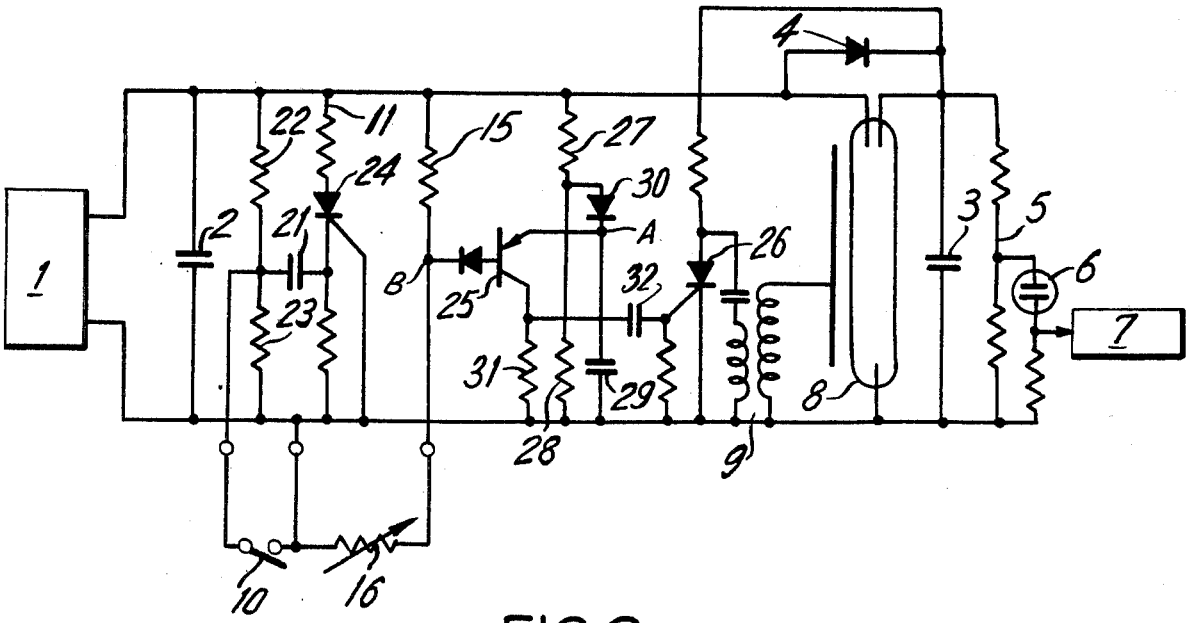
FIG. 2 is a circuit diagram showing a second example of the present invention.
Figure 3:
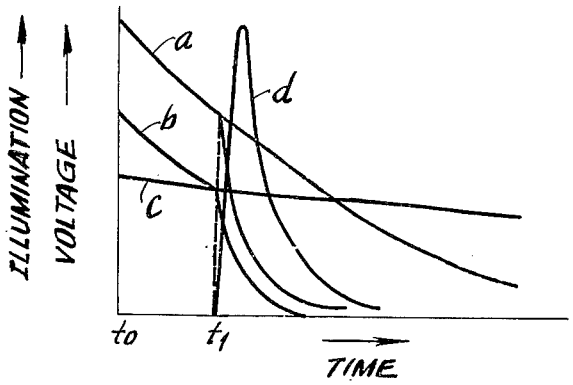
FIG. 3 is a drawing to show the function of the second example.

The second example shown in FIG. 2 and FIG. 3 is to show an automatic flash device which automatically emits light when the amount of electricity charged across the main capacitor reaches to such value as corresponding to the flash photographic information. Also the difference from the first example lies in that while the discharge in the first example is started by the first step pressing down of the shutter release member, the discharge in the second example is started by closing of the synchronizing contact.

The second example shall be explained. 21 is a capacitor for starting up discharge. This capacitor 21 is charged by a divider circuit containing resistors 22, 23, and is discharged by closing the synchronizing contact 10. 20 is SCR provided at the discharge circuit 11 and is placed in a conductive state by the discharge of the capacitor 21, to discharge the electric charge of the main capacitor 2. 25 is a transistor having its base connected with the output terminal of the discharge control circuit. When this transistor 25 is placed in a conductive state, the trigger circuit 9 is activated through SCR 26 of the circuit. 27 and 28 are resistors of the emitter circuit of the transistor 25. 30 is a diode, 31 is a collector resistor of the transistor 25, and 32 is a coupling capacitor.

FIG. 3 is to show the functions of the flash device shown in FIG. 2. The abscissa of FIG. 3 shows time while the ordinate shows the voltage of each part shown in FIG. 2 and the amount of light emitted.

Next, the functions of the second example shall be explained. When the switch (not shown in the drawing) of the power circuit 1 is closed, the charging across the main capacitor 2 and the auxiliary capacitor is started with the output from the circuit 1. As the charging proceeds and the terminal voltage reaches to such a level as enabling the discharge tube to emit light, the neon lamp 6 is lighted, and the power source circuit 1 is controlled by the output of the neon lamp 6 thus the charging is stopped. At the same time as the charging of the main capacitor 2, etc., the capacitor 5 is charged with the voltage of the bleeder circuit, 3, 4. Next, the resistor 16 is adjusted by a flash photographic information setting member which is not shown in the drawing. When the synchronizing contact 10 is closed at this state by a shutter button, the charge of the capacitor 21 flows to the resistor 32 through the contact 10, and the electric potential at the SCR 24 side of the resistor 23 becomes negative. By this the control electrode of the SCR 24 becomes positive, placing the SCR 24 in a conductive state. As the SCR 24 is placed in on state the electric charge accumulated at the main capacitor 2 starts to be discharged by the discharging path including the SCR 24. An example of such discharging curve is as shown by a curve *a* in FIG. 3, and as the SCR 24 becomes on at a point $t_0$ the terminal voltage of the main capacitor 2 lowers as shown in the drawing. The resistance value composing the discharging path of the main capacitor 2 is so selected that the discharging of the same is completed in about 1/30 of a second. While the main capacitor 2 discharges, the terminal voltage of the auxiliary capacitor 3 is kept at an almost constant value. The voltage of the bleeder point (point B) by the resistor 15 and the resistor 16 lowers as shown by the curve *b* of FIG. 3 with the discharging of the main capacitor 2. On the other hand as the emitter circuit of the transistor 25 is composed by a constant voltage circuit, the voltage at point A is kept at an almost constant value as shown by the curve *c* in FIG. 3. As shown in FIG. 3 the transistor 25 is converted to on from off at such time $t_1$ that the voltage at the point B becomes equal to the voltage at the point A, generating pulse signal at its collector resistor 31, and said voltage is impressed on the control electrode of the SCR 26 through the coupling capacitor 32, thus the SCR 26 is triggered. When the SCR 26 becomes on, high voltage trigger pulse is given to the trigger electrode of the flash discharge tube by the trigger circuit 9, having the discharge tube 8 emit light.

Figure 4:
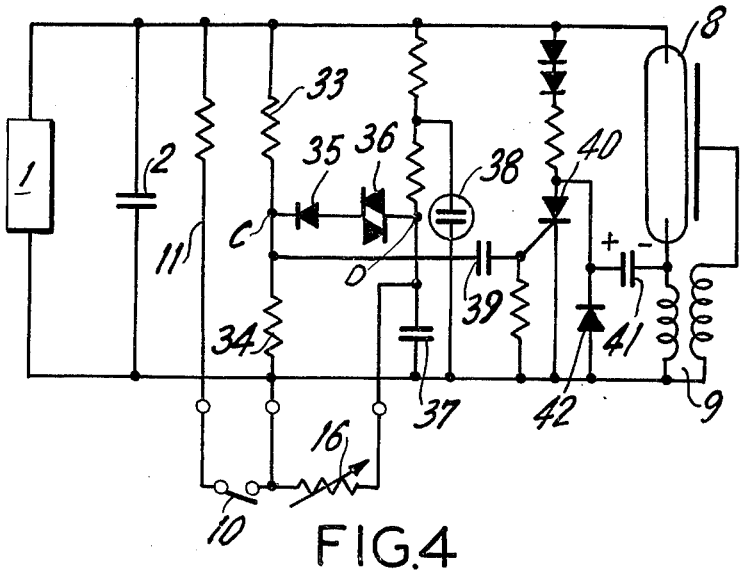
FIG. 4 is a circuit diagram showing a third example of the present invention.

FIG. 4 is a circuit connection diagram to show the third example of the present invention, wherein ordinary bipolar flash discharge tube and the voltage generated at a primary coil of the trigger circuit being connected in series with said tube are utilized. In the drawing, 2 is a main capacitor, and 11 is a discharging circuit of the main capacitor 2. 33 and 34 are resistors of the bleeder circuit. 35 is a diode, 36 is a pulse element of a semi-conductor, 37 is a capacitor and 38 is a neon lamp to indicate completion of the charging and to regulate the voltage of the circuit to a constant level. 39 is a coupling capacitor, 40 is SCR, 41 is a capacitor of a trigger circuit, and 42 is a diode to prevent a reverse current.

The function of this device is as follows. As the main capacitor 2 is charged by the power source circuit 1 and its terminal voltage reaches to such voltage as enabling the flash discharge tube to emit light, the neon lamp 38 is lighted. The capacitor 39 of the trigger circuit is charged, and such voltage as shown by FIG. 4 is generated between said terminals. The distance to an object is set at the variable resistor for setting distance in a camera, and the synchronizing contact 10 is closed by a shutter button. By this the electric charge accumulated across the main capacitor 2 starts to be discharged through the resistor 11. As the terminal voltage of the main capacitor 2 lowers the voltage of the point C of the bleeder circuit 33, 34 lowers (refer to FIG. 3). During said process, the voltage at point D is maintained at an almost constant level corresponding to the set value of the variable resistor 16. When the voltage at point "C" against the voltage at point "D" becomes lower than the break over voltage of the pulse element 36, the pulse element 36 is converted from off to on, generating pulse signals at the resistor 34. Said pulses are impressed on the control electrode of the SCR 40 through the coupling capacitor 39, placing the SCR in on state. As the SCR 40 becomes on, the electric charge of the trigger capacitor 41 is discharged, inducing voltage at the primary coil of the booster transformer 9. As said voltage is as high as about 100 volts, such voltage as being higher by 100 volts than the terminal voltage of the main capacitor will work between the both electrodes of the flash discharge tube at a moment as the flash discharge tube 8 is triggered, thereby even if the terminal voltage of the main capacitor is lower than the voltage enabling illumination the discharge tube emits light. Therefore the extent to which the amount of light can be controlled is expanded.

In the above mentioned examples 2 and 3, when the shutter release is pressed down and the shutter is opened, closing the synchronizing contact utilizing the synchronizing contact which is closed at a certain time of shutter opening, the main capacitor is discharged to such a value as corresponding to the flash information. As the amount of electricity charged at the main capacitor lowers to said value, automatic emitting of flash light will be made. As it is inconvenient that the shutter is closed at a same time when the synchronizing contact is closed, F-contact or M-contact may be used as a synchronizing contact.

Contrast to the examples mentioned above, in the fourth example shown in FIG. 5, on a shutter release or closing of a synchronizing contact, a main capacitor is made to have constant current discharge for a predetermined period of time (which can be varied by the flash information), and the amount of flash light emitted is made to correspond to the flash information.

Figure 5:
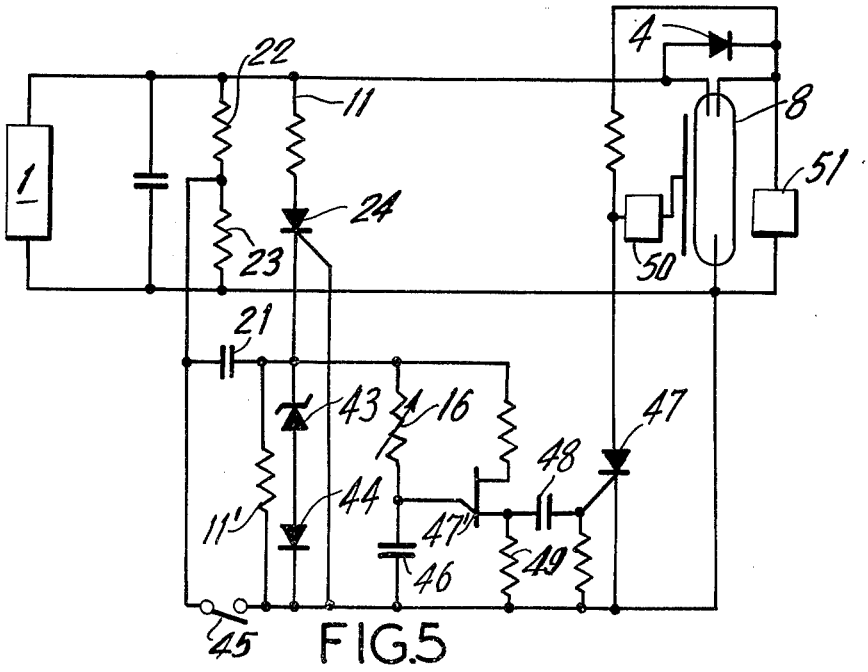
FIG. 5 is a circuit diagram showing a fourth example of the present invention.

In FIG. 5, a delay circuit to cause flash illumination after a predetermined period of time from the moment of shutter release or opening of synchronizing contact, and an automatic flash circuit are combined to the circuit shown in FIG. 2. Therefore same parts as shown in FIG. 2 are identified with same marks or numbers. In the drawing numeral 43 is a constant voltage diode (Zener diode), numeral 44 is a diode, and numeral 45 is a synchronizing contact or a contact to be closed by the shutter release. Numeral 46 is a capacitor of a time constant circuit. Numeral 47 is a uni-junction transistor (UJT), numeral 48 is a coupling capacitor, and numeral 49 is a resistor. Numeral 50 is a trigger circuit and 51 shows an auxiliary capacitor circuit.

In this circuit as the contact 45 becomes on, the SCR 24 is triggered to become conductive and the discharging current of the main capacitor flows to the resistor 11' and its terminal voltage is regulated to a constant value by a Zener diode. A timing circuit is activated by said voltage. Therefore, by placing the contact 45 in on state, UJT 47 becomes on with such delay time as determined by the resistor 16 and the capacitor 46, and the SCR 24 is triggered by the pulse output thereof, causing the flash discharge tube 8 to emit light. Therefore, the amount of light can be controlled by varying the resistor 16 in association with a distance ring, etc.

What is claimed is:

1. An automatic flash device responsive to photographic information comprising a power source, a main capacitor chargeable to a predetermined value by said power source, a discharge circuit connected to said main capacitor, a control circuit including variable resistance means coupled to said discharge circuit for controlling the amount of electricity discharged by said discharge circuit in response to distance to the object being photographed and producing a signal when the amount of electricity corresponding to said distance is discharged, a synchronizing contact coupled to said discharge circuit to actuate the discharge circuit for starting the discharge of said main capacitor through said discharge circuit, a flash tube connected to said main capacitor, and trigger means connected to said control circuit and flash tube to trigger said flash tube in response to said signal from the control circuit to cause said flash tube to emit light when the amount of charge at the main capacitor reaches a value which corresponds to said distance.

2. An automatic device for operating a flash discharge tube and responsive to the shutter release of a camera, comprising a power source, a main capacitor chargeable to a given value by said power source, a discharge circuit connected to said main capacitor, means coupled to the discharge circuit and responsive to the shutter release means to start the discharge of said main capacitor by said discharge circuit, a control circuit which generates an output when the charge at the main capacitor is discharged to a value corresponding to the distance to the object being photographed, and means coupled to the control circuit and actuated by the output of said control circuit for coupling the capacitor across the tube and generating a signal which triggers the tube.

3. An automatic flash device responsive to a shutter release that operates in sequential first and second steps in a camera, comprising a power source, a main capacitor chargeable to a predetermined value by said power source, a discharge circuit connected to said main capacitor, a control circuit coupled to the discharge circuit to constrain the amount of electricity discharged from said discharge circuit to correspond to the distance to the object being photographed, means coupled to the discharge circuit and responsive to the first step of the shutter release means of a camera to start the discharging of the main capacitor, a flash tube connected to said main capacitor, a trigger circuit connected to said flash tube and responsive to the second step of shutter release for flashing of said flash tube.

4. An automatic flash responsive to the shutter release of a camera and to the distance to the object being photographed, comprising a power source, a main capacitor chargeable to a certain value by said power source, a discharge circuit connected to said main capacitor, a means coupled to the discharge circuit and actuated by the shutter release means of a camera to start the discharging of said main capacitor, a timer circuit including variable resistor means responsive to the distance, means coupling said timer circuit to said discharge circuit to stop the discharging of the main capacitor by the output of said timer circuit, a flash discharge tube connected across said main capacitor, and trigger means coupled to the flash discharge tube to trigger said flash discharge tube to emit light in response to the output of said timer circuit.

5. An automatic flash device operable in response to a power source on the basis of photographic information relating to the distance between the camera and the scene being focused, comprising a power source, a main capacitor coupled to the power source chargeable to a given voltage by said power source, a discharge circuit connected to said main capacitor, shutter release means, actuating means coupled to said discharge circuit and actuated by the shutter release means to start the discharge of said main capacitor, a detecting circuit connected to said main capacitor for detecting the amount of energy discharged from said main capacitor and for generating a triggering signal when the amount of discharged energy reaches predetermined value, distance information setting means contained in said detecting means for setting said predetermined value to correspond to the distance, a flash discharge tube connected across said main capacitor, and trigger means connected to said detecting means to trigger said flash discharge tube by said triggering signal, whereby electric energy is discharged from said main capacitor to emit given amount of flash light corresponding to said distance.

6. An automatic flash device operable in response to a power source on the basis of photographic information relating to the distance the camera is from the object being focused, comprising a main capacitor, network means connecting said main capacitor to the power source so that the power source can charge said main capacitor to a predetermined level, circuit means including a discharge circuit connected to the main capacitor for discharging a portion of the energy across said capacitor, control means in said discharge circuit and responsive to said distance, said control means including starting means to start discharge of said main capacitor in accordance with release of the shutter, and said control means including a timing circuit having a variable element the value of which is adjusted according to said distance for establishing the amount of energy discharged from said capacitor on the basis of said distance, flash tube means connected across said capacitor so that said capacitor can ignite said flash tube means when said flash tube means is triggered, and trigger means coupled to said flash tube means and said control means for triggering operation of said flash tube means in response to said signal so that the amount of light emitted by said flash tube means depends upon the energy remaining across said main capacitor.

7. The device according to claim 1, wherein said discharge circuit includes switching means actuated when said synchronizing contact is turned on so as to start discharge of said main capacitor.

8. The device according to claim 1, wherein said control circuit comprises:

a. a detecting circuit connected to said main capacitor and including said variable resistance for detecting the amount of energy discharged from said main capacitor in order to generate an output signal corresponding to said distance, and b. a switching circuit connected to said detecting circuit and said means coupled to the discharge circuit for actuating said trigger means when said detecting circuit generates the predetermined output.

9. The device according to claim 8, wherein said switching circuit comprises a neon light which responds to predetermined output of said detecting circuit.

10. An automatic flash responsive to the shutter release of a camera and to the distance to the object being photographed, comprising a power source, a main capacitor chargeable to a given value by said power source, a discharge circuit connected to said main capacitor, starting means coupled to the discharge circuit and actuated by the shutter release means to start the discharge of said main capacitor, a timer circuit actuated in response to discharge of said main capacitor and including variable resistor means responsive to the distance, adjusting means for adjusting said variable resistor corresponding to the distance, a flash discharge tube coupled to said main capacitor, trigger means for triggering said flash discharge tube, coupling means coupling said timer circuit to said trigger means to actuate said trigger means when output of said timer circuit reaches a value corresponding to said distance, the amount of energy discharged from said main capacitor and that remains in said main capacitor being controlled corresponding to said distance to emit flash light.

11. An automatic flash according to claim 10, wherein said discharge circuit includes a constant voltage breakdown element connected across said timer circuit.

12. An automatic flash according to claim 11, wherein said constant voltage breakdown element is a Zener diode.

13. An automatic flash device operable in response to a power source on the basis of photographic information relating to the distance between the camera and scene being focused comprising;

a. a power source, b. storage means connected in said power source and chargeable to a certain value of flash energy by said power source, c. a first discharge circuit connected to said storage means, d. flash means connected through said first discharge circuit to said storage means, e. a second discharge circuit connected to said storage means, f. actuating means coupled to said second discharge circuit and actuated by the shutter release means of the camera to start the discharging of said storage means, g. a control circuit connected to said second discharge circuit for controlling the amount of energy in said storage means corresponding to said distance, said control circuit including a detecting circuit connected to said storage means to detect the amount of energy in said storage means in order to generate output signal at the time when said energy reaches certain value, said control circuit being responsive to said output signal for ending discharge through said second discharge circuit, h. distance information setting means in said detecting circuit for setting a detecting level corresponding to said distance, whereby the amount of energy in said storage means is controlled by said control circuit and, i. trigger means coupled to said flash tube means for triggering said flash tube means, said flash tube means discharging certain amount of energy in said storage means through said first discharge circuit to emit flash light.

14. An automatic flash device according to claim 13, wherein said second discharge circuit comprises switching means which turns on in accordance with the operation of said shutter release means and turns off in response to the output of said detecting circuit.

15. An automatic flash device according to claim 13, wherein said second discharge circuit comprises a thyristor having a gate electrode connected to said actuating means, said actuating means impressing a gate signal on said gate electrode at the time when said actuating means is actuated.

16. An automatic flash device according to claim 15, wherein said actuating means includes a discharging circuit connected to said storage means and charged in advance and switching means operated in accordance with said shutter release means for impressing discharging voltage on gate electrode of thyristor, the output terminals of said discharging circuit being connected to gate electrode and the negative electrode of thyristor.

17. An automatic flash device according to claim 13, wherein said storage means is a capacitor.

18. An automatic flash device according to claim 13, wherein said detecting circuit comprises a switching circuit including a transistor and a bleeder resistor connected in parallel to said storage means, the base of said transistor being connected to said bleeder resistor, said transistor generating a trigger signal when the voltage of the base reaches the predetermined value.

19. An automatic flash device according to claim 13, wherein said distance information setting means is a variable resistor the resistance of which varies corresponding to rotation angle of a focus ring mounted on the lens barrel of the camera.

20. An automatic flash device according to claim 13, wherein said trigger means is connected to said output of said detecting circuit for triggering said flash tube means in response to the output signal of said detecting circuit.

21. An apparatus as in claim 20, wherein said circuit means includes starting means for initiating discharge of said capacitor, and wherein said trigger means responds to said discharge means for triggering the operation of said flash tube means a predetermined time after discharge of said capacitor.

22. An apparatus as in claim 21, wherein said control means includes a timing capacitor and said variable element and forming a timing circuit, said variable element being a resistor variable in response to said distance.

23. An automatic flash device responsive to photographic information, comprising a power source, a main capacitor chargeable to a predetermined value by said power source, a discharge circuit connected to said main capacitor, a control circuit including variable adjusting means coupled to said discharge circuit for controlling the amount of electricity discharged by said discharge circuit in response to distance to the object being photographed and producing a trigger signal when the amount of electricity is discharged, a shutter release means, an actuating means coupled to said shutter release means and discharge circuit for actuating said discharge circuit in response to the shutter release operation to start the discharging of said main capacitor through said discharge circuit, a flash tube means connected across said main capacitor so that said capacitor can ignite said flash tube means when said flash tube means is triggered, and trigger means coupled to flash tube means for triggering operation of said flash tube means so that the amount of light emitted by said flash tube means depends upon the energy remaining across said main capacitor.

24. An automatic flash device operable in response to a power source on the basis of photographic information relating to the distance the camera is from the object being focused, comprising a main capacitor, network means connecting said main capacitor to the power source so that the power source can charge said main capacitor to a predetermined level; circuit means including a discharge circuit connected to the main capacitor for discharging a portion of the energy across said capacitor, control means in said discharge circuit and having a variable element the value of which is adjusted according to said distance for establishing the amount of energy discharged from said capacitor on the basis of said distance, flash tube means connected across said capacitor so that said capacitor can ignite said flash tube means when said flash tube means for triggering operation of said flash tube means so that the amount of light emitted by said flash tube means depends upon the energy remaining across said main capacitor.

* * * * *